US008442408B2

(12) United States Patent
Shiba et al.

(10) Patent No.: US 8,442,408 B2
(45) Date of Patent: May 14, 2013

(54) SENSOR SYSTEM AND APPARATUS FOR IDENTIFYING RECORDING MEDIUM

(75) Inventors: Hiroshi Shiba, Numazu (JP); Yoshitaka Kukubo, Susono (JP); Masanori Akita, Mishimia (JP); Tomoyuki Okada, Nagaizumi-machi (JP); Kengo Umeda, Himeji (JP)

(73) Assignee: Canon Kabushiki Kaisha, Tokyo (JP)

( * ) Notice: Subject to any disclaimer, the term of this patent is extended or adjusted under 35 U.S.C. 154(b) by 37 days.

(21) Appl. No.: 12/412,025

(22) Filed: Mar. 26, 2009

(65) Prior Publication Data

US 2009/0226195 A1 Sep. 10, 2009

Related U.S. Application Data

(62) Division of application No. 11/303,242, filed on Dec. 16, 2005, now Pat. No. 7,529,493.

(30) Foreign Application Priority Data

Dec. 20, 2004 (JP) ..... 2004-368414
Nov. 22, 2005 (JP) ..... 2005-337714

(51) Int. Cl.
*G03G 15/00* (2006.01)

(52) U.S. Cl.
USPC ..... 399/45; 356/445

(58) Field of Classification Search ..... 399/45; 356/238.1, 238.2, 429–431, 445–448, 630–632
See application file for complete search history.

(56) References Cited

U.S. PATENT DOCUMENTS

| | | | | |
|---|---|---|---|---|
| 6,291,829 | B1 * | 9/2001 | Allen et al. | 250/559.07 |
| 6,600,167 | B2 | 7/2003 | Sano | |
| 6,838,387 | B1 | 9/2005 | Belanger | |

FOREIGN PATENT DOCUMENTS

| | | | | |
|---|---|---|---|---|
| JP | 02-005055 | U | | 1/1990 |
| JP | 10160687 | A | * | 6/1998 |
| JP | 11-224515 | A | | 8/1999 |
| JP | 2000-221142 | A | | 8/2000 |
| JP | 2001-356640 | A | | 12/2001 |
| JP | 2005-529313 | A | | 9/2005 |
| WO | 2003-086771 | A2 | | 10/2003 |

OTHER PUBLICATIONS

English machine translation of JP 10-160687 A.*

* cited by examiner

*Primary Examiner* — Walter L Lindsay, Jr.
*Assistant Examiner* — Ruth N Labombard
(74) *Attorney, Agent, or Firm* — Canon USA Inc IP Division

(57) ABSTRACT

A sensor system includes an LED configured to emit light to a recording medium and a light-receiving sensor configured to receive a transmitted light that has passed through the recording medium after having been emitted from the LED to the recording medium. An emitting optical axis of the LED is away from a perpendicular receiving optical axis of the light-receiving sensor.

15 Claims, 11 Drawing Sheets

SENSOR SYSTEM AND APPARATUS FOR IDENTIFYING RECORDING MEDIUM

CROSS REFERENCE TO RELATED APPLICATIONS

The present application is a divisional of U.S. patent application Ser. No. 11/303,242, filed Dec. 16, 2005, entitled "SENSOR SYSTEM AND APPARATUS FOR IDENTIFYING RECORDING MEDIUM", the content of which is expressly incorporated by reference herein in its entirety. Further, the present divisional application claims priority from Japanese Patent Application Nos. 2004-368414 filed Dec. 20, 2004 and No. 2005-337714 filed Nov. 22, 2005, which is also hereby incorporated by reference herein in its entirety.

BACKGROUND OF THE INVENTION

1. Field of the Invention

The present invention relates to sensor systems for detecting recording media. In particular, the present invention relates to a sensor system for detecting a recording medium in an image forming apparatus and an apparatus that uses the sensor system and that identifies a recording medium.

2. Description of the Related Art

Conventionally, some image forming apparatuses for forming toner images on recording media by an electrophotography process incorporate picture reading sensors for identifying recording media. In such an image forming apparatus, various types of recording media are used. In order to sufficiently fuse and fix an image for all types of recording media, identifying a recording medium and switching to a fixing condition suitable for the identified recording medium before performing a fixing process are necessary.

Examples of the method for identifying a recording medium include a method in which a user sets the size and kind (hereinafter referred to also as sheet type) of medium on an operation panel of an image forming apparatus and a fixing processing condition is switched depending on the settings. Examples of the fixing processing condition include a fixing temperature and a speed of conveying a recording medium passing through a fixing unit (fuser).

When an overhead transparency (OHT) is used as the recording medium, a transmission sensor disposed within the image forming apparatus automatically detects whether the recording medium is an OHT or not. If light passes through the recording medium, the recording medium is identified to be an OHT; if not, the recording medium is identified to be plain paper other than the OHT. In accordance with this identification, the fixing temperature or the speed of conveying the recording medium is set.

FIG. 8 illustrates the structure of the known recording-medium identification sensor 118. The recording-medium identification sensor 118 includes a light-emitting diode (LED) 1 serving as a light emitting unit, an image pickup element 2 serving as an image reading unit, a condensing lens 3, and an imaging lens 4. A surface of a recording-medium conveying guide 8 or a surface of the recording medium 107 on the recording-medium conveying guide 8 is radiated with light beams emitted from the LED 1 reaches via the condensing lens 3. Light beams reflected from the recording medium 107 are gathered to form an image on the image pickup element 2 via the imaging lens 4. Therefore, a picture of the surface of the recording-medium conveying guide 8 or a picture of the surface of the recording medium 107 is read. In this example, the LED 1 is disposed such that the surface of the recording medium 107 is obliquely radiated with light beams emitted from the LED 1 at a predetermined angle, as shown in FIG. 8.

FIG. 9 illustrates the relationship between pictures of the surfaces of the recording media 107 read by the image pickup element 2 in the recording-medium identification sensor 118 and the pictures of the outputs from the image pickup element 2 that are processed into a digitized form of 8×8 pixels. This digitization is performed by converting an analog output from the image pickup element 2 into, for example, 8-bit pixel data with an analog-to-digital (A/D) converting unit (not shown).

FIG. 9 further illustrates an enlarged picture 50 indicating the surface of a coarse recording medium A whose surface fibers are relatively rough, an enlarged picture 51 indicating the surface of a generally used recording medium B, which is a sheet of plain paper, and an enlarged picture 52 indicating the surface of a glossy recording medium C whose surface fibers are fully compressed. When these enlarged pictures 50 to 52 read by the image pickup element 2 are digitized, the results are shown as pictures 53 to 55 in FIG. 9.

As illustrated in FIG. 9, pictures of surfaces of recording media vary depending on the kind of recording medium. This is mainly because the state of fibers of the surface of a recording medium varies. The picture that is digitized from the picture of the surface of the recording medium read by the image pickup element 2, as previously described, varies with the state of paper fibers of the surface of the recording medium, so that these variations allow identification of the recording medium.

FIG. 10 is a flowchart showing control of a condition for a fixing process using the known recording-medium identification sensor 118. The process flow of FIG. 10 is executed by a control processor included in the color image forming apparatus.

In FIG. 10, the control processor first lights the LED 1 (step S001) and reads a picture of the recording medium 107 by the image pickup element 2 (step S002). This picture reading process is carried out multiple times to read multiple areas on the recording medium 107.

The control processor extinguishes the LED 1 (step S003) and adjusts constants for gain calculation and filter calculation in a gain adjusting unit (not shown) and a filter calculating unit (not shown), respectively, included in the control processor (step S004). These gain and filter calculation processes are performed in accordance with programs stored in a read-only memory (ROM) (not shown) within the control processor.

The gain calculation is performed by, for example, adjusting the gain of an analog output from the image pickup element 2. If the amount of light reflected from the surface of the recording medium 107 is too large or too small, the picture of the surface of the recording medium 107 cannot be sufficiently read and thus the variations in the picture cannot be derived. In this case, the gain is adjusted by the control processor.

For the filter calculation, when an analog output from the image pickup element 2 is converted into 8-bit digital data with 256 levels of gray, calculation processing of 1/32, 1/16, 1/4, or the like, is performed. In other words, a noise component of an output from the image pickup element 2 is removed.

The control processor determines whether information about pictures sufficient for the next calculation of picture comparison can be obtained or not (step S005). If it is determined that sufficient picture information can be obtained, the picture comparison calculation described below is performed (step S006), the sheet type is determined on the basis of the result of the picture comparison calculation (step S007), and a fixing temperature corresponding to the determined sheet type is set (step S008).

The control processor controls the temperature in a fixing unit (not shown) in such a way that, if the sheet type denotes a sheet of paper whose surface fibers are coarse, like the recording medium A shown in FIG. 9, the fixing temperature is set high, and if the sheet type denotes a sheet of paper whose surface fibers are smooth, like the recording medium C, the fixing temperature is set low.

A method for performing the picture comparison calculation mentioned above is explained below. In the picture comparison calculation process, a pixel that exhibits a maximum output (Dmax) and a pixel that exhibits a minimum output (Dmin) are derived from the result of reading pictures of multiple areas of the surface of the recording medium 107. This process is performed for every read picture, and the results are subjected to averaging processing.

If the surface has coarse paper fibers, like the recording medium A, a large number of shadows of the fibers are present. As a result, the difference between a bright area and a dark area is large, and Dmax−Dmin is increased. In contrast to this, if the surface has smooth paper fibers, like the recording medium C, shadows of the fibers are small, and thus Dmax−Dmin is reduced. The sheet type of the recording media 107 is determined by this comparison.

Since the control processor needs to perform sampling processing of pictures from the image pickup element 2, the gain calculation processing, and the filter calculation processing in real time, it is desirable that a digital signal processor be used as the control processor.

An image forming apparatus for determining the sheet type of recording media described above is disclosed in, for example, Japanese Patent Laid-Open No. 2002-182518 (corresponding to U.S. Pat. No. 6,668,144).

Since a large number of sheet types of available paper have come into use in recent years, the known image forming apparatus described above has become unable to handle all of the sheet types by using only a detection system of the recording-medium identification sensor. This may cause a condition for fixing processing to be improperly set so that the degree of fixing may be poor. In particular, for an OHT, because a dedicated sheet is present for each printer product, if the condition for fixing processing is not optimized, a resulting image may be not sufficiently fixed or the sheet may be jammed.

In addition, there are various known methods for determining the sheet type of recording media such as thick paper. However, a method using a reflective sensor and a method for mechanically detecting the thickness of a sheet of paper, for example, require a dedicated sensor for detecting the thickness of a sheet of paper. This increases the total cost of ownership for an image forming apparatus, and therefore, it leads to poor cost performance.

As one approach to address the problems described above, in order to identify a recording medium more precisely, in addition to known identification, identification is proposed that uses a unit configured to determine the thickness of recording media, such as thick paper, thin paper, and the like, in accordance with the intensity of transmitted light (the amount of transmitted light) by illuminating the recording media from a side adjacent to the back of the recording medium.

However, since a known identification sensor configured to illuminate the recording media from the side adjacent to the back of the recording medium has a structure in which regular transmitted light directly enters the identification sensor, the identification of an OHT or a sheet of thin paper is largely affected by light emitted from an LED. This degrades the accuracy of identifying the OHT or thin paper.

SUMMARY OF THE INVENTION

The present invention provides an improved sensor system and an improved apparatus for identifying a recording medium.

Moreover, the present invention provides a sensor system and an apparatus for identifying a recording medium that include a recording-medium identification sensor for detecting the type of the recording medium with increased accuracy.

According to a first aspect of the present invention, a sensor system includes a first light-emitting unit configured to emit light to a recording medium and a light receiving unit configured to receive a transmitted light component that has passed through the recording medium after having been emitted from the first light-emitting unit to the recording medium. A first emitting optical axis of the first light emitting unit is away from a perpendicular receiving optical axis of the light receiving unit.

According to a second aspect of the present invention, a sensor system includes a first light-emitting unit configured to emit light to a recording medium, a light receiving unit configured to receive a transmitted light component that has passed through the recording medium after having been emitted from the first light emitting unit to the recording medium, and a light diffusing member disposed between the first light-emitting unit and the light receiving unit.

According to a third aspect of the present invention, an apparatus for identifying a recording medium includes a sensor system configured to detect a characteristic of the recording medium and a control unit. The sensor system includes a first light-emitting unit configured to emit light to the recording medium and a light receiving unit configured to receive a transmitted light component that has passed through the recording medium after having been emitted from the first light-emitting unit to the recording medium. In the sensor system, a first emitting optical axis of the first light emitting unit is away from a perpendicular receiving optical axis of the light receiving unit. The control unit is configured to identify the recording medium on the basis of an output from the light receiving unit.

According to a fourth aspect of the present invention, an apparatus for identifying a recording medium includes a sensor system configured to detect a characteristic of the recording medium and a control unit. The sensor system includes a first light-emitting unit configured to emit light to the recording medium and a light receiving unit configured to receive a transmitted light component that has passed through the recording medium after having been emitted from the first light-emitting unit to the recording medium. In the sensor system, a light diffusing member is disposed between the first light-emitting unit and the light receiving unit. The control unit is configured to identify the recording medium on the basis of an output from the light receiving unit.

Further features of the present invention will become apparent from the following description of exemplary embodiments with reference to the attached drawings.

DESCRIPTION OF THE EMBODIMENTS

Figure 1:
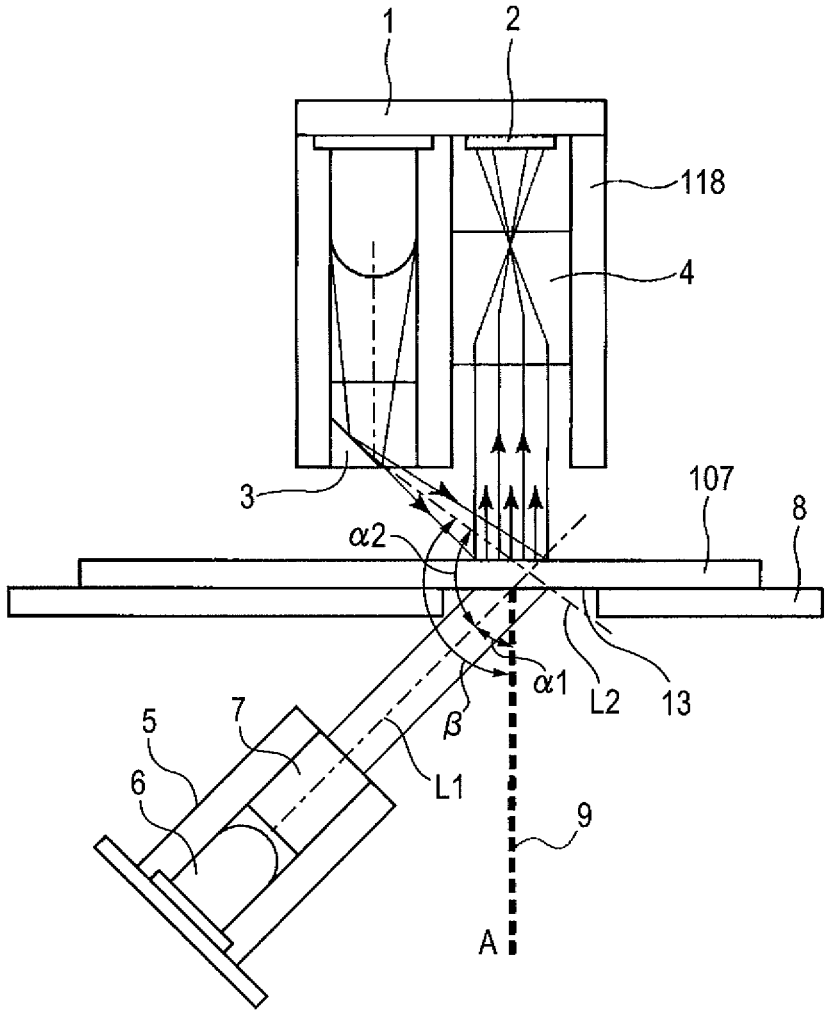
FIG. 1 illustrates a structure of a sensor system according to a first exemplary embodiment of the present invention.

Exemplary embodiments, various features and aspects of the present invention are described below with reference to the drawings. In the drawings, the same reference numerals have been retained for similar parts which have the same functions.

First Exemplary Embodiment

Figure 6:
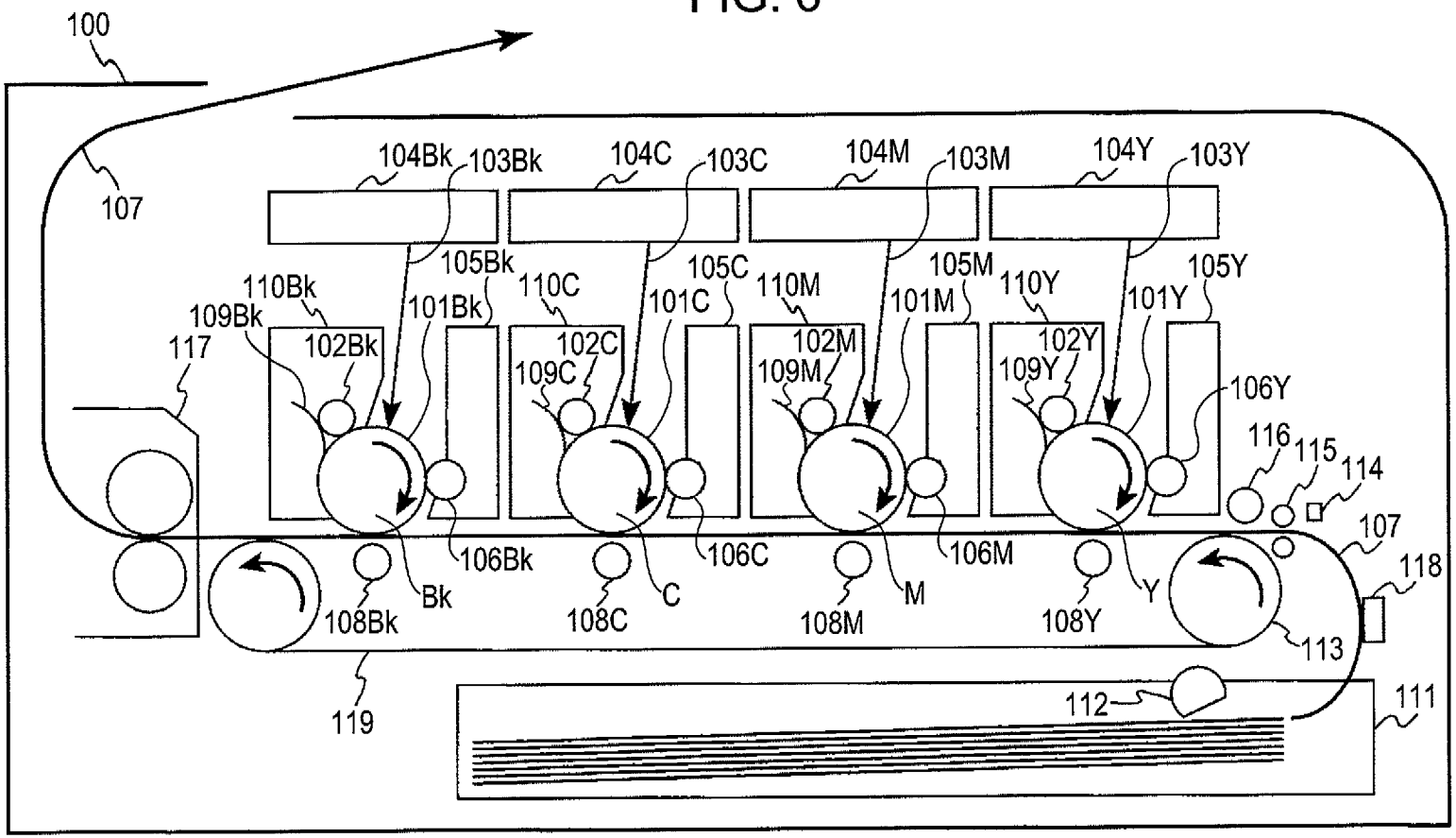
FIG. 6 illustrates a structure of a color image forming apparatus according to at least one exemplary embodiment.

FIG. 6 illustrates an exemplary structure of a color image forming apparatus 100 according to a first embodiment of the present invention. The color image forming apparatus 100 includes four image forming sections corresponding to four colors, one image forming section each for yellow (Y), magenta (M), cyan (C), and black (Bk). These image forming sections include the following components corresponding to each color: image bearing members 101Y, 101M, 101C, and 101Bk, charging units 102Y, 102M, 102C, and 102Bk for uniformly charging the image bearing members 101Y, 101M, 101C, and 101Bk up to a predetermined potential, laser scanner units 104Y, 104M, 104C, and 104Bk for radiating the charged image bearing members 101Y to 101Bk with laser light beams 103Y, 103M, 103C, and 103Bk corresponding to the respective color image data sets to form the respective electrostatic latent images on the image bearing members 101Y to 101Bk, developing units 105Y, 105M, 105C, and 105Bk for developing the electrostatic latent images formed on the image bearing members 101Y to 101Bk to visualize the images, sleeve rollers 106Y, 106M, 106C, and 106Bk for supplying the respective color toner particles within the developing units 105Y to 105Bk to the image bearing members 101Y to 101Bk, transferring units 108Y, 108M, 108C, and 108Bk for transferring the toner images formed on the image bearing members 101Y to 101Bk to a recording medium 107, and cleaning units 109Y, 109M, 109C, and 109Bk for removing the remaining toner particles on the image bearing members 101Y to 101Bk after the toner images are transferred. Waste toner units 110Y, 110M, 110C, and 110Bk are used for accepting waste toner particles.

In the bottom of the color image forming apparatus 100, a sheet cassette 111 holding the recording media 107 is disposed. Along the path for conveying each of the recording media 107 from the sheet cassette 111, a pickup roller 112 for supplying the recording medium 107, a recording-medium conveying unit 113 for conveying the supplied recording medium 107 from image forming sections to a fixing unit, a detection sensor 114 for detecting the leading edge of the recording medium 107 to measure the timing for an image forming process, resist rollers 115 for stopping the recording medium 107 to match the recording medium 107 with the timing for transferring developed images formed on the image bearing members 101Y to 101Bk, and an adsorptive roller 116 for causing the recording medium 107 to electrostatically absorb on the recording-medium conveying unit 113 are disposed. The recording medium 107 that is waiting at the resist rollers 115 is conveyed along a conveyer belt 119, which is disposed in contact with the image bearing members 101Y to 101Bk for each color part of the image forming sections, while the timing is provided in consideration of the result of detection performed by the detection sensor 114 and the image forming process, so that the toner image for each color is successively transferred to the recording medium 107 by the transferring units 108Y to 108Bk. A fixing unit 117 functions so as to thermally fuse and fix the four-color toner image transferred to the recording medium 107. The recording medium 107 with the fixed toner image is conveyed to the outside, and the image forming operation is completed.

The color image forming apparatus 100 shown in FIG. 6 includes a recording-medium identification sensor 118, and a sensor system (described later) that uses the recording-medium identification sensor 118 and that is shown in FIG. 1 is configured to illuminate a surface of the recording medium 107 supplied and conveyed from the sheet cassette 111, gather light reflected from the recording medium 107, and form an image so as to capture a picture of a specific area of the recording medium 107.

Figure 7:
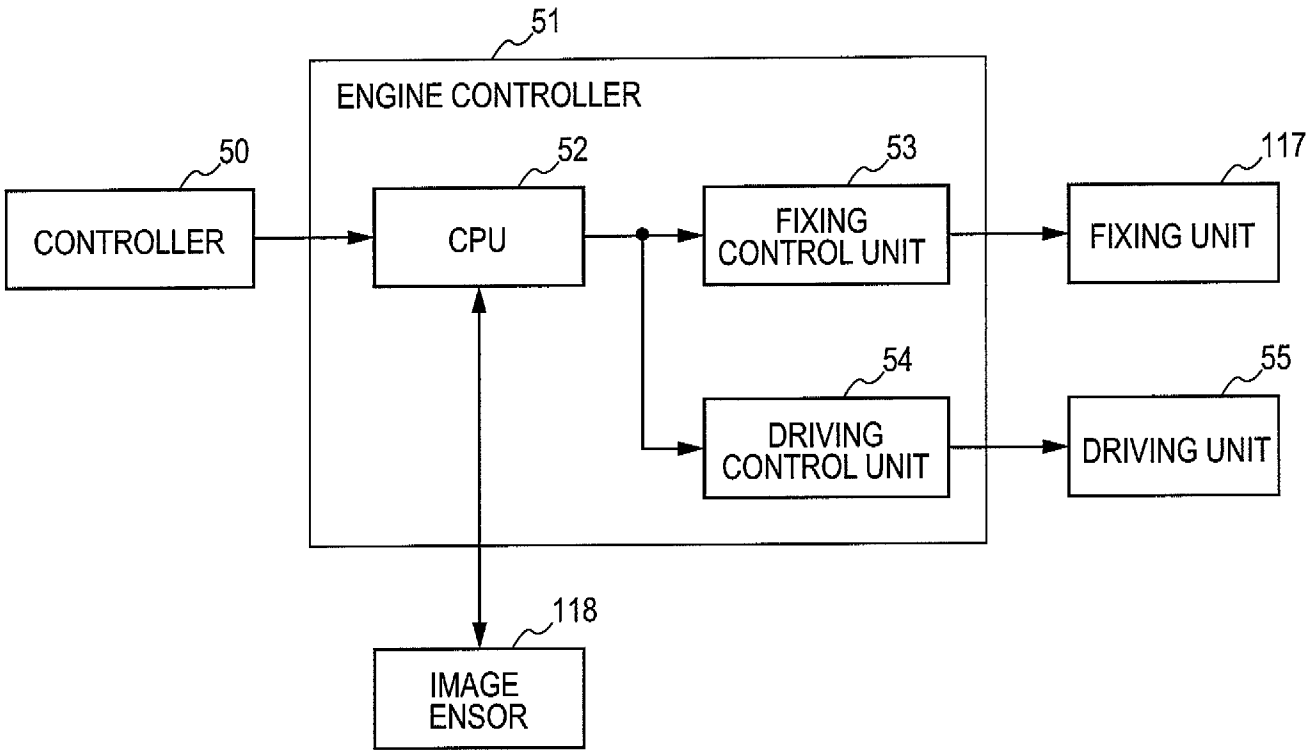
FIG. 7 is a block diagram of a control system in an image forming apparatus for detecting a recording medium by using a recording-medium identification sensor according to at least one exemplary embodiment.
Figure 8:
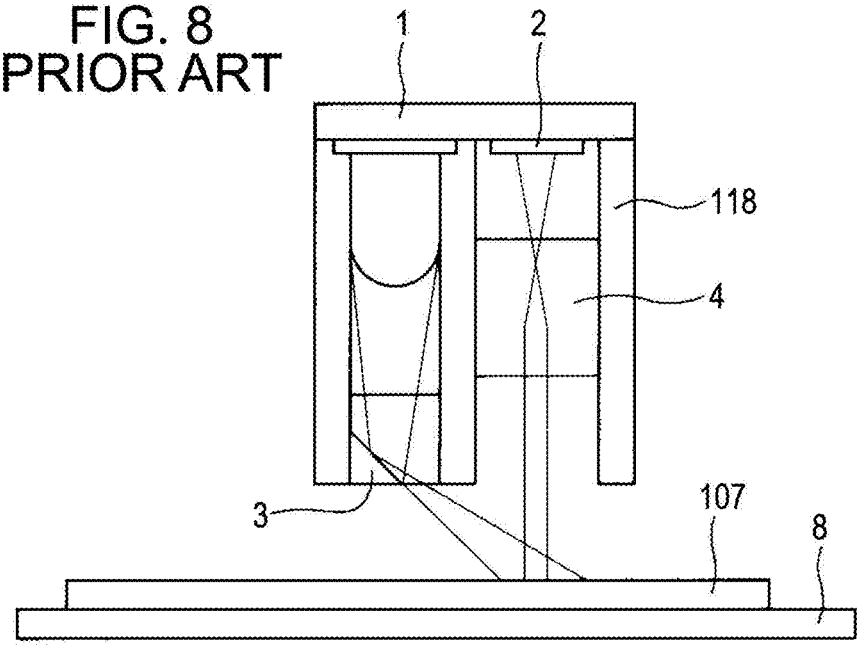
FIG. 8 PRIOR ART
FIG. 8 illustrates a structure of a known recording-medium identification sensor.
Figure 9:
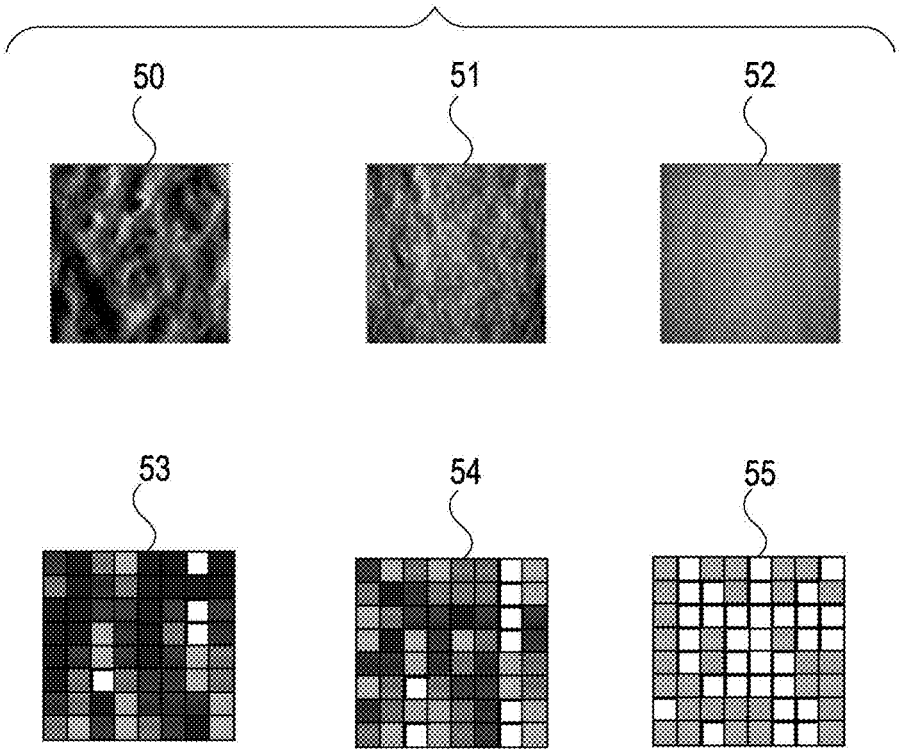
FIG. 9 PRIOR ART
FIG. 9 illustrates an example of the result of digitizing an output from a known recording-medium identification sensor into the form of 8×8 pixels.
Figure 10:
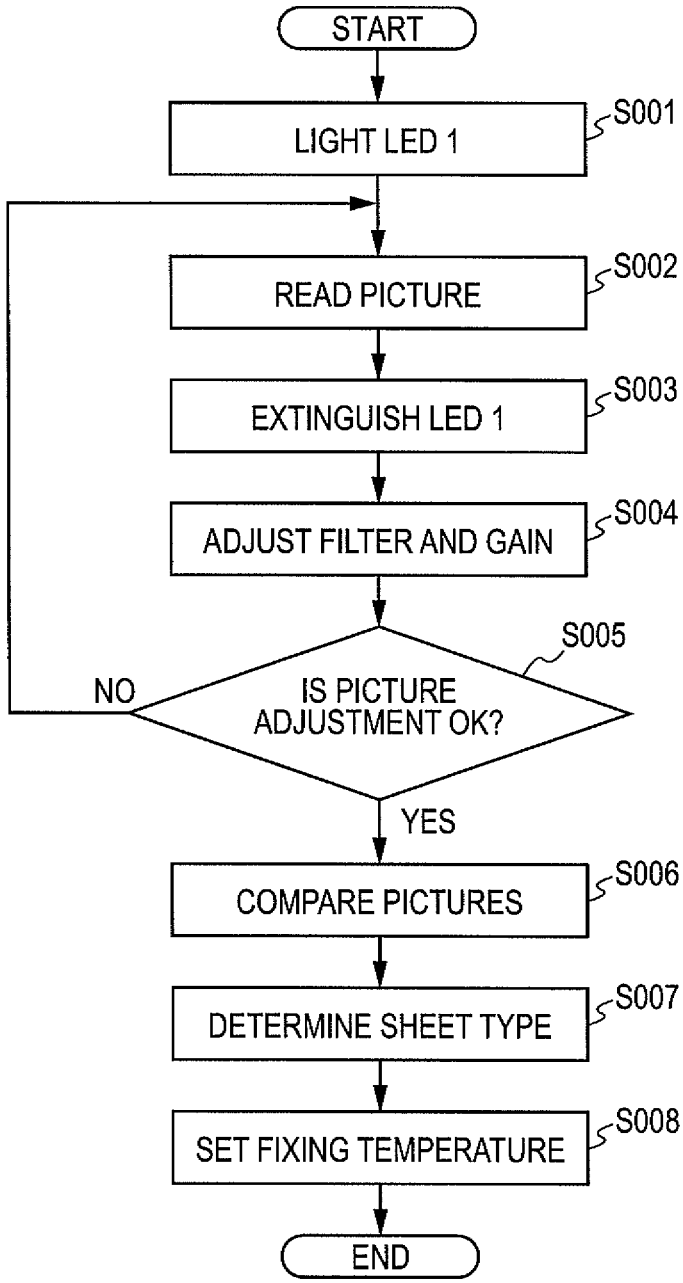
FIG. 10 PRIOR ART
FIG. 10 is a flowchart of a control process for a condition for fixing processing using a known recording-medium identification sensor.

FIG. 7 is a block diagram of a control system in the color image forming apparatus 100 for detecting the recording medium 107 by using the recording-medium identification sensor 118. A controller 50 sends a print signal to an engine part of the color image forming apparatus 100 according to instructions from a host computer. An engine controller 51 controls the engine part of the color image forming apparatus 100. A central processing unit (CPU) 52 in a control processor controls the image sensor system (described later) shown in FIG. 1 and operation blocks in the color image forming apparatus 100. A fixing control unit 53 supplies power to the fixing unit 117 according to instructions from the CPU 52. A driving control unit 54 controls a driving unit 55 in the color image forming apparatus 100 according to instructions from the CPU 52. The driving unit 55 performs processing regarding image formation in the color image forming apparatus 100. More specifically, the driving control unit 54 and the driving unit 55 are usually made up of a plurality of units, including supplying and conveying units, image forming sections, and fixing and outputting units. In this first exemplary embodiment, these components are referred to collectively as the driving control unit 54 and the driving unit 55.

With the architecture described above, when a print signal is sent from the controller 50, the CPU 52 then begins to supply the recording medium 107. At the position where the recording medium 107 is stopped in front of the resist rollers 115, on the basis of an output from the recording-medium identification sensor 118, the CPU 52 determines the sheet type of the recording medium 107. In accordance with the determined sheet type, the CPU 52 sets a target value for an optimal fixing temperature and a conveying speed and sends the settings as instructions to the fixing control unit 53 and the driving control unit 54. In accordance with the instructions from the CPU 52, the fixing control unit 53 and the driving control unit 54 perform fixing and conveying on the basis of the predetermined settings, so that the recording medium 107 is ejected from the color image forming apparatus 100.

FIG. 1 illustrates the structure of the sensor system according to the first exemplary embodiment. The first exemplary embodiment utilizes a recording-medium identification sensor 118 which includes a LED 1 for reflected light which serves as a light-emitting unit, an image pickup element 2 serving as an image reading unit functioning as a light-receiving element, a condensing lens 3, and an imaging lens 4. A surface of a recording-medium conveying guide 8 or a surface of the recording medium 107 on the recording-medium conveying guide 8 is radiated with light beams emitted from the LED 1 via the condensing lens 3. It is noted that the recording-medium conveying guide 8 may include a slot, opening or window 13. Light beams reflected from the recording medium 107 are gathered to form an image on the image pickup element 2 via the imaging lens 4. In this first exemplary embodiment, the LED 1 is disposed such that the surface of the recording medium 107 is obliquely radiated with light beams emitted from the LED 1 at a predetermined angle, as shown in FIG. 1.

In FIG. 1, additionally an LED unit 5 is disposed opposite to the recording-medium identification sensor 118 in such a way that the recording medium 107 is disposed between the LED unit 5 and the recording-medium identification sensor 118. A LED 6 for transmitted light illuminates the recording medium 107 from the side adjacent to the back of the recording medium 107. As shown in FIG. 1, the LED 6 for transmitted light is oriented such that the transmitted light is projected through the opening 13 of the recording-medium conveying guide 8. A condensing lens 7 is used for gathering light beams from the LED 6 for transmitted light to emit light to the back of the recording medium 107. The recording-medium conveying guide 8 guides the recording medium 107 and, as has been discussed, includes the window 13 to allow the recording medium 107 to be radiated with the light from the side adjacent to the back of the recording medium 107.

The sensor system shown in FIG. 1 described above reads a picture of the surface of the recording medium 107 and the amount of transmitted light that has passed through the recording medium 107 after having been emitted from the side adjacent to the back of the recording medium 107. In FIG. 1, a perpendicular line or axis 9 is oriented at a right angle to the surface of the window 13 used for illuminating the recording medium 107 with light from the side which is adjacent to the back of the recording medium 107. The perpendicular axis 9 is disposed opposite to the recording-medium identification sensor 118, and the recording medium 107 is disposed between the recording-medium identification sensor 118 and the perpendicular axis 9. In this first exemplary embodiment, the perpendicular axis 9 corresponds to a perpendicular receiving optical axis of the image pickup element 2 serving as the light-receiving element. The placement of the LED unit 5 is next described. In the structure shown in FIG. 1, L1 denotes an emitting optical axis of light emitted from the LED 6 for transmitted light. $\alpha 1$ is the angle between the L1 and the perpendicular axis 9. L2 denotes an emitting optical axis of light emitted from the LED 1. $\alpha 2$ is the angle between the L1 and the L2. $\beta$ is the angle between the L2 and the perpendicular axis 9. The LED unit 5 is disposed so as to satisfy $\alpha 1<90°$ and where $\alpha 2<\beta$.

Figure 2:
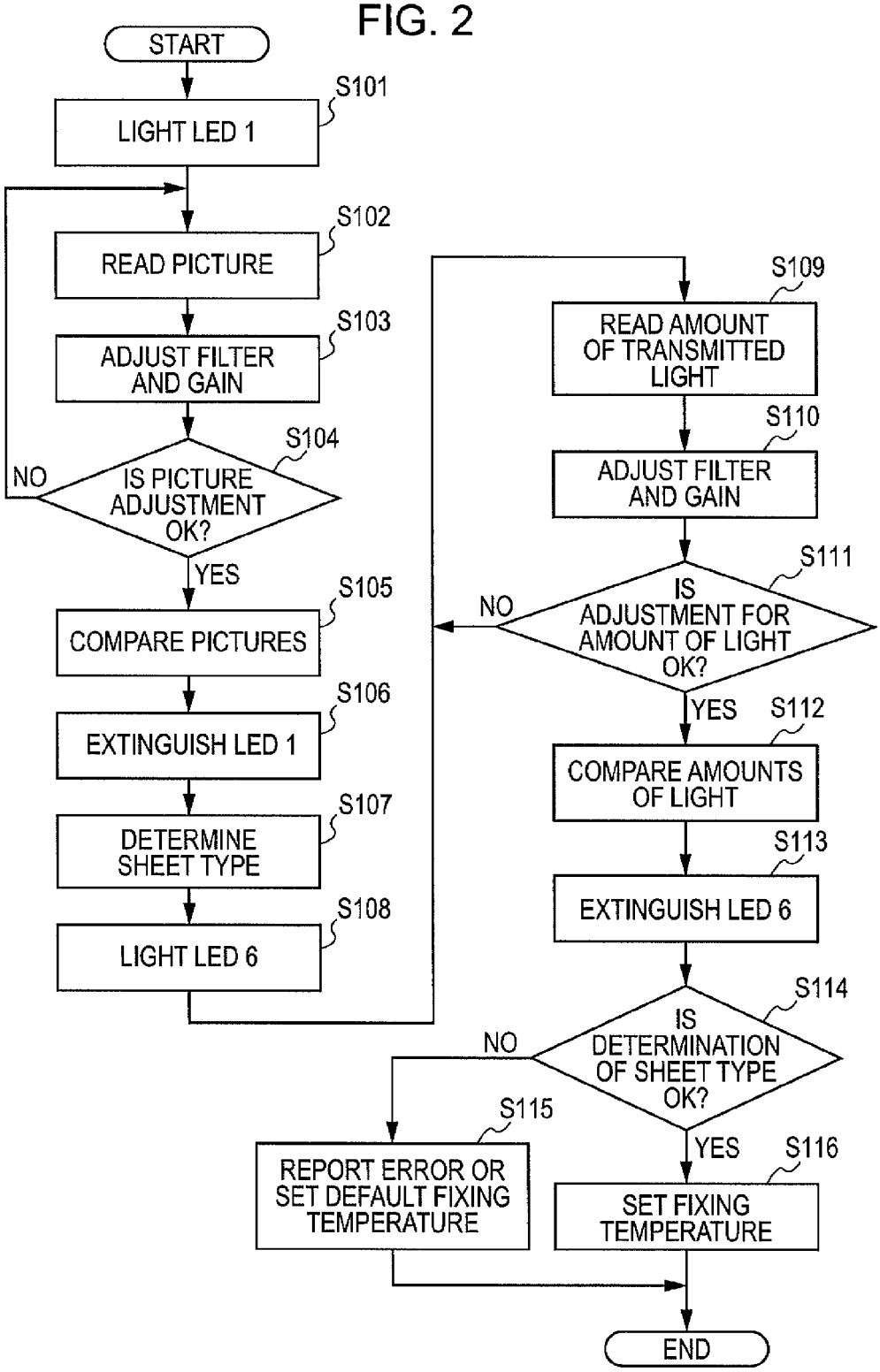
FIG. 2 is a flowchart of a control process for a condition for fixing processing using the sensor system according to the first exemplary embodiment.

FIG. 2 is a flowchart of an exemplary control process for a condition for fixing processing using the sensor system shown in FIG. 1 according to the first exemplary embodiment. The process flow shown in FIG. 2 is executed by the CPU 52 in the control processor included in the color image forming apparatus 100. The operations of the color image forming apparatus 100 are described below with reference to FIGS. 1 and 2.

First, the control processor lights the LED 1 (step S101) and reads a picture of the recording medium 107 by the image pickup element 2 (step S102). This picture reading process is carried out multiple times to read multiple areas on the recording medium 107. The CPU 52 adjusts constants for gain calculation and filter calculation in a gain adjusting unit (not shown) and a filter calculating unit (not shown), respectively, included in the control processor (step S103). The CPU 52 determines whether information about pictures sufficient for the next calculation of picture comparison can be obtained or not (step S104). If it is determined that sufficient picture information can be obtained, the picture comparison calculation is performed (step S105). Then, the LED 1 is extinguished (step S106).

Next, the sheet type is determined on the basis of the result of the picture comparison calculation (step S107). Since the determination of the sheet type in step S107 is based on the state of surface smoothness of the recording medium 107, plain paper, OHT, and glossy paper can be identified. However, examples of the sheet types generally usable include thin paper and thick paper, and therefore, various basis weights ($g/m^2$) are present. For example, a basis weight of –64 $g/m^2$ indicates thin paper, a basis weight of 65 to 105 $g/m^2$ indicates plain thick paper (plain paper), a basis weight of 106 to 135 $g/m^2$ indicates thick paper 1, and a basis weight of 136 $g/m^2$— indicates thick paper 2.

Since these types of the recording media 107 cannot be sufficiently determined only on the basis of the state of surface smoothness, the recording media 107 are subjected to further type determination using the LED unit 5 including the LED 6 for transmitted light. First, the CPU 52 lights the LED 6 for transmitted light (step S108) and reads the amount of transmitted light that has passed through the recording medium 107 by the image pickup element 2 (step S109). The CPU 52 adjusts constants for gain calculation and filter calculation in a gain adjusting unit (not shown) and a filter calculating unit (not shown), respectively, included in the control processor (step S110). The CPU 52 determines whether the amount of incident light sufficient for the next calculation regarding the amount of transmitted light can be obtained or not (step S111). If it is determined that sufficient incident light can be obtained, comparison calculation of the amounts of transmitted light is performed (step S112). Then, the LED 6 for transmitted light is extinguished (step S113). In the comparison calculation of the amounts of transmitted light, when detection of the amount of light has, for example, 8-bit resolution, the amounts of transmitted light read by the image pickup element 2 are converted into values ranging from 0 to 255 (least significant byte (LSB)).

Figure 3:
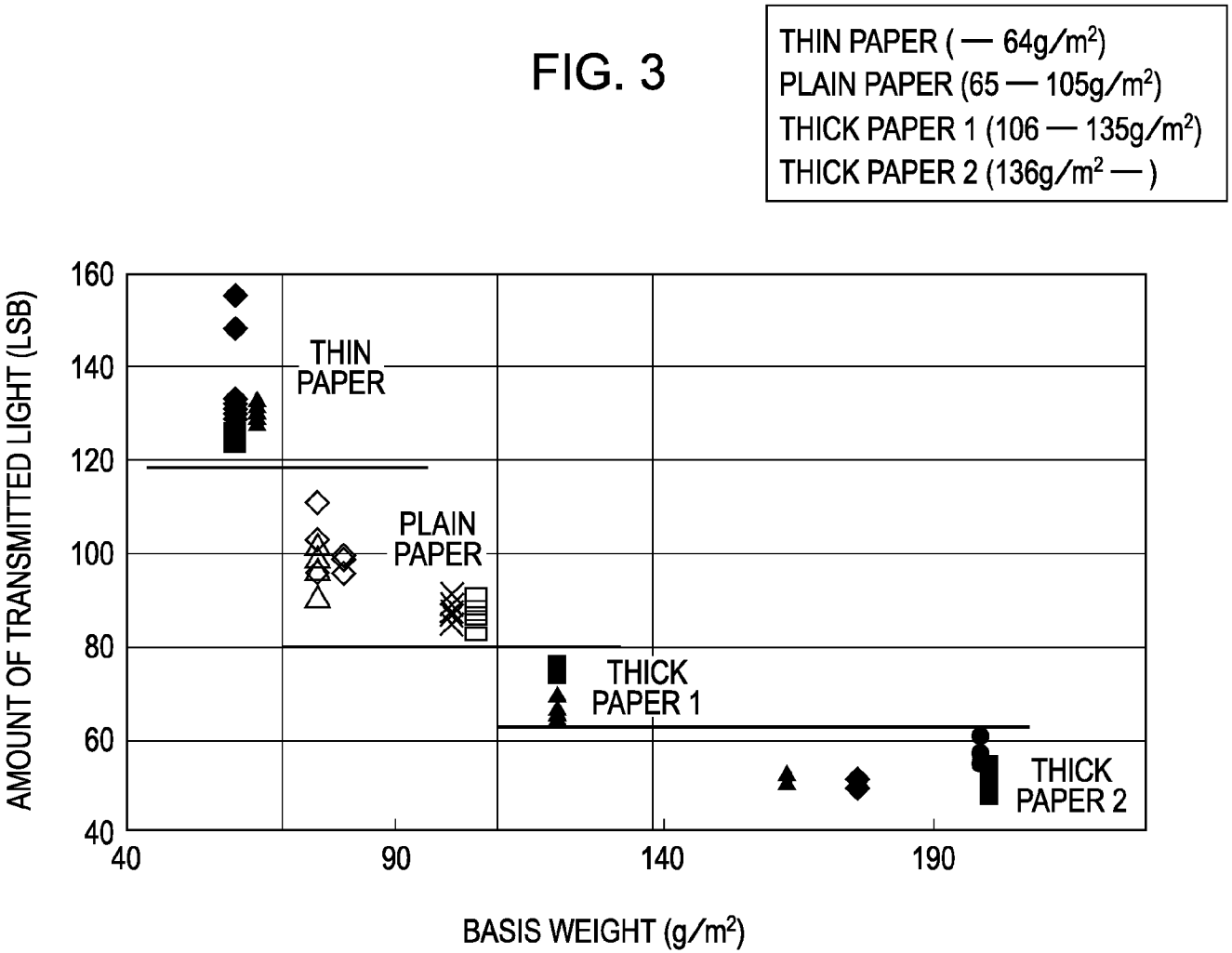
FIG. 3 illustrates an example of the determination of a basis weight of paper by using the amount of transmitted light from an LED according to the first exemplary embodiment.

The CPU 52 determines the sheet type of the recording medium 107 on the basis of the result of the comparison calculation of the amounts of transmitted light (step S114). FIG. 3 illustrates an example of this processing, i.e., the determination of the basis weight of the recording medium 107 by using the amount of transmitted light that has been emitted from the LED 6 for transmitted light. As shown in FIG. 3, setting thresholds by the levels of the amounts of transmitted light can discriminate among thin paper, plain thick paper (plain paper), thick paper 1, and thick paper 2. For example, in the detection of the amount of light having 8-bit resolution, setting a threshold at around 120/255 can discriminate between thin paper and plain thick paper, setting a threshold at around 80/255 can discriminate between plain thick paper and thick paper 1, and setting a threshold at around 65/255 can discriminated between thick paper 1 and thick paper 2.

If, in step S114, the sheet type is determined in accordance with a combination of the results in steps S107 and S114 (the kind and the thickness of a recording medium), the CPU 52 sets a fixing temperature suitable for the determined sheet type (step S116). If, in step S114, the sheet type is not determined, for example, in a case where the medium is special paper, which is not described above, or where detection fails, the CPU 52 reports an error to the host controller or sets a default fixing temperature for plain paper (step S115), and the processing is completed.

If the LED unit 5 is disposed in the direction of the perpendicular axis 9 of the image pickup element 2 so as to face the recording-medium identification sensor 118 in such a way that the recording medium 107 is disposed between the LED unit 5 and the recording-medium identification sensor 118, a picture of light emitted from the LED 6 for transmitted light directly enters the image pickup element 2. As a result, when an OHT or a sheet of thin paper is to be identified as the recording medium 107 conveyed along the path of conveying the medium, the output level of light emitted from the LED 6 for transmitted light may be too high or may deviate from the output range. In this case, the difference between the output levels with respect to the recording medium 107 cannot be detected.

Therefore, in the first exemplary embodiment, the LED unit 5 is disposed away from the perpendicular 9 of the image pickup element 2 at a predetermined angle (the angle can be set according to specifications of products) so that diffused transmitted light can enter the image pickup element 2.

Figure 11:
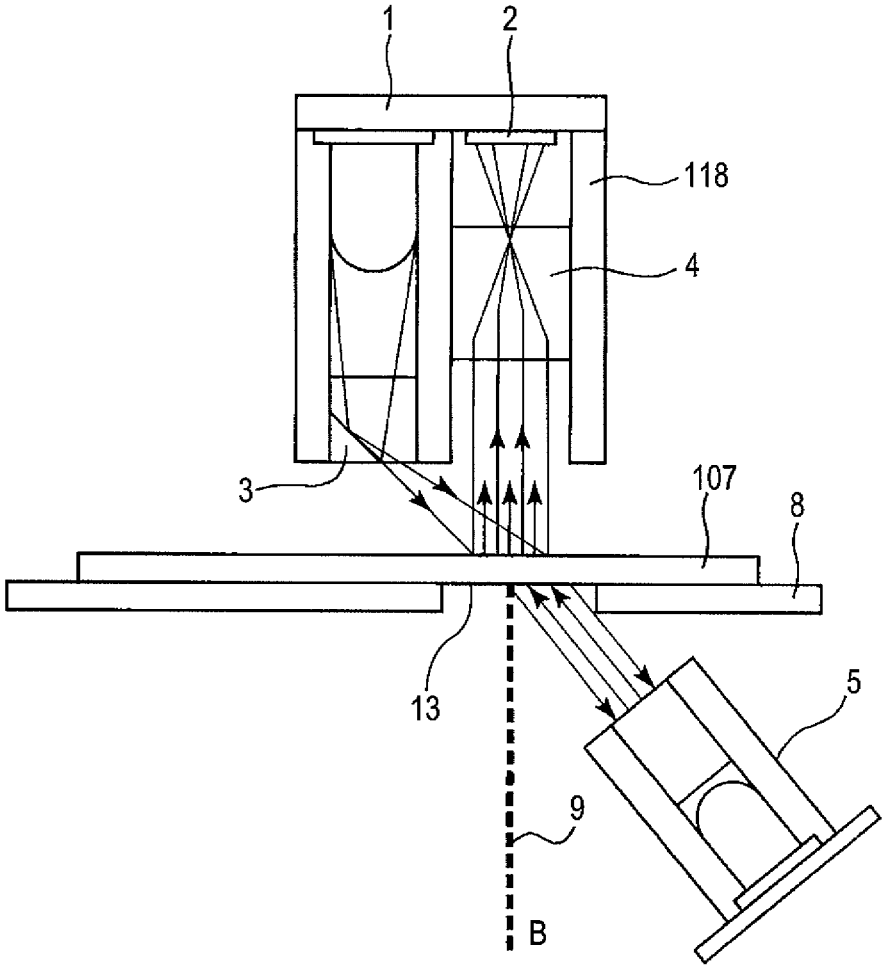
FIG. 11 is an illustration for explaining the sensor system according to the first exemplary embodiment.

FIG. 11 illustrates a case in which the LED unit 5 is disposed in a space B with respect to the perpendicular axis 9 so as to face light emitted from the LED 1 of the recording-medium identification sensor 118 in such a way that the recording medium 107 is disposed between the recording-medium identification sensor 118 and the LED unit 5. In this case, when the surface of the recording medium 107 is to be detected by the recording-medium identification sensor 118, if a high transparent sheet, such as an OHT, is radiated with light, a transmitted light component reaches the LED unit 5 and a reflected light component reflected from the LED unit 5 enters the image pickup element 2. In other words, the reflected light component from the LED unit 5 affects an incident light component to the image pickup element 2. As a result, it is desirable that the LED unit 5 be disposed so as not to face light emitted from the LED 1 of the recording-medium identification sensor 118 in such a way that the recording medium 107 is disposed between the recording-medium identification sensor 118 and the LED unit 5. In other words, it is desirable that the LED unit 5 be present in a space A with respect to the perpendicular 9, which is shown in FIG. 1.

As described above, the LED 6 for transmitted light is disposed obliquely with respect to the recording-medium identification sensor 118, so that the amount of transmitted light that has passed through the recording medium 107 is detected by using diffused transmitted light. Therefore, the sheet type of the recording medium 107 can be determined more precisely.

Furthermore, the structure described above prevents the accuracy of detection performed by the recording-medium identification sensor 118 from decreasing and realizes the detection with high accuracy.

Second Exemplary Embodiment

The basic structure of the image forming apparatus according to a second exemplary embodiment is similar to the structure according to the first exemplary embodiment, which is described with reference to FIGS. 6 and 7. However, according top the second embodiment, the image forming apparatus in the second exemplary embodiment uses the sensor system shown in FIG. 4 in place of the sensor system shown in FIG. 1.

Figure 4:
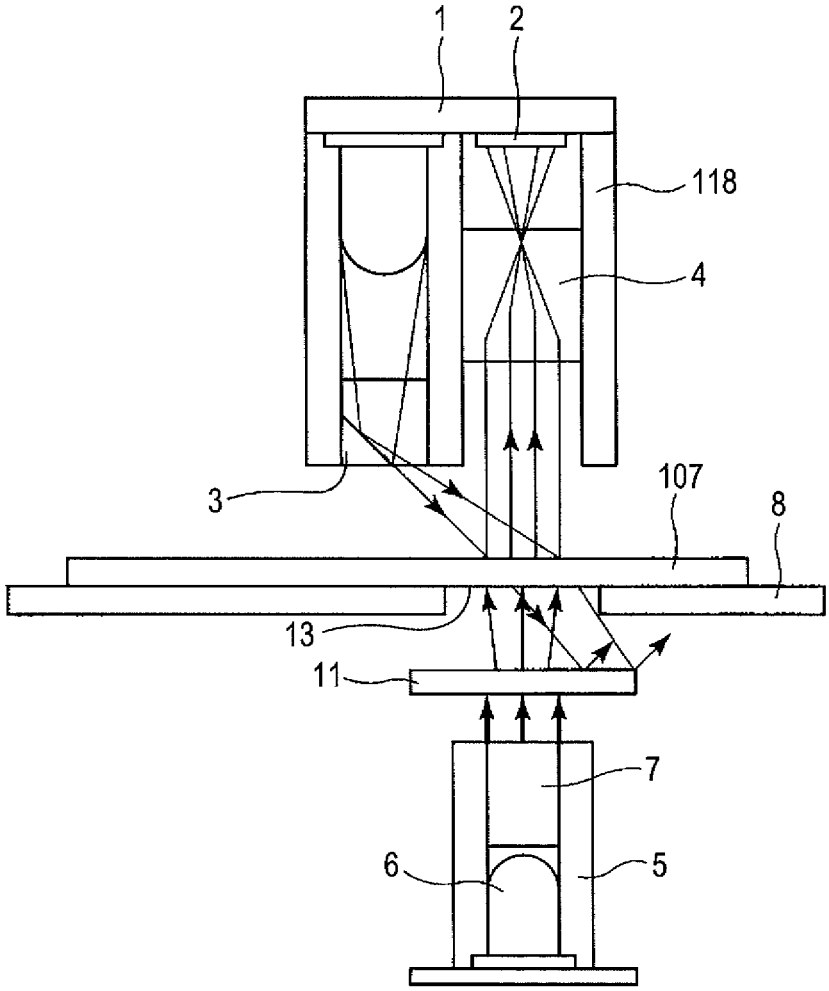
FIG. 4 illustrates a structure of the sensor system according to a second exemplary embodiment of the present invention.

FIG. 4 illustrates an exemplary structure of the sensor system according to the second exemplary embodiment. FIG. 4 shows the recording-medium identification sensor 118 which includes the LED 1 for reflected light serving as a light-emitting unit, the image pickup element 2 serving as an image reading unit, the condensing lens 3, and the imaging lens 4. The surface of the recording-medium conveying guide 8 or the surface of the recording medium 107 on the recording-medium conveying guide 8 is radiated with light beams emitted from the LED 1 via the condensing lens 3. Light beams reflected from the recording medium 107 are gathered to form an image on the image pickup element 2 via the imaging lens 4. In this second exemplary embodiment, the LED 1 is disposed such that the surface of the recording medium 107 is obliquely radiated with light beams emitted from the LED 1 at a predetermined angle, as shown in FIG. 4.

In FIG. 4, the LED unit 5 is disposed opposite to the recording-medium identification sensor 118 in such a way that the recording medium 107 is disposed between the LED unit 5 and the recording-medium identification sensor 118. The LED 6 for transmitted light illuminates the recording medium 107 from the side adjacent to the back of the recording medium 107. The condensing lens 7 is used for gathering light beams from the LED 6 for transmitted light to emit light to the back of the recording medium 107. The recording-medium conveying guide 8 guides the recording medium 107 and, in the second exemplary embodiment, includes the window 13 to allow the recording medium 107 to be radiated with the light from the side adjacent to the back of the recording medium 107.

In FIG. 4, a light diffusing plate 11 formed from, for example, a polyacetal (POM) resin material is disposed. Polyacetal resin materials are easy to mold and inexpensive so they can be used with ease. The light diffusing plate 11 is disposed at a position opposite to the recording-medium identification sensor 118 between the recording medium 107 and the LED unit 5 in such a way that the recording medium 107 is disposed between the light diffusing plate 11 and the recording-medium identification sensor 118, as shown in FIG. 4. The sensor system described above shown in FIG. 4 reads a picture of the surface of the recording medium 107 and the amount of transmitted light that has passed through the recording medium 107 after having been emitted from a side adjacent to the back of the recording medium 107.

The operations according to the second exemplary embodiment are similar to those in the first exemplary embodiment, which are described above with reference to FIGS. 2 and 3.

In FIG. 4, when the LED unit 5 emits light to the light diffusing plate 11 from below the light diffusing plate 11, the view from above the light diffusing plate 11 can be considered as a surface illuminant in which light is made uniform by the light diffusing plate 11. Therefore, if the LED unit 5 is disposed at a position that faces the image pickup element 2 in the direction of the perpendicular, a picture of light emitted from the LED 6 for transmitted light does not directly enter the image pickup element 2. In other words, the levels of intensity of light emitted from the LED 6 for transmitted light are made uniform by the light diffusing plate 11, and as a result, the image pickup element 2 can detect the difference between the output levels even when the recording medium 107 to be identified is an OHT or a thin sheet.

Moreover, even when transmitted light that has passed through the recording medium 107 after having been emitted from the LED 1 for reflected light reaches the light diffusing plate 11, the light exhibits low reflectivity because the coarseness of the light diffusing plate 11 diffuses the light. Therefore, the effects of re-reflected light, which is described in the first exemplary embodiment, i.e., the effects of light that has been re-reflected by the light diffusing plate 11 after having been emitted from the LED 1 are minimized.

Therefore, according to the second exemplary embodiment, light emitted from the LED unit 5 enters the image pickup element 2 via the light diffusing plate 11 and the window 13, so that the position of the LED unit 5 can be freely selected. Furthermore, this prevents the accuracy of detection performed by the recording-medium identification sensor 118 from decreasing and realizes the detection with high accuracy.

In the light diffusing plate 11 according to the second exemplary embodiment, the reflectivity varies with the material, the surface treatment, and the density. The material, the surface treatment, and the density can be freely selected so that the light entering the image pickup element 2 cannot affect the detection. With respect to the effects of the light diffusing plate 11, it is possible to measure in advance an effect to the image pickup element 2 when the recording medium 107 is not present and to then cancel the effect through calculation by using a measured value when the recording medium 107 is present.

Third Exemplary Embodiment

The basic structure of the image forming apparatus according to a third exemplary embodiment is similar to the structure according to the first and second exemplary embodiments, which is described with reference to FIGS. 6 and 7. The image forming apparatus in the third exemplary embodiment uses an exemplary sensor system shown in FIG. 5 in place of the sensor system shown in FIG. 1 according to the first exemplary embodiment or that shown in FIG. 4 according to the second exemplary embodiment.

Figure 5:
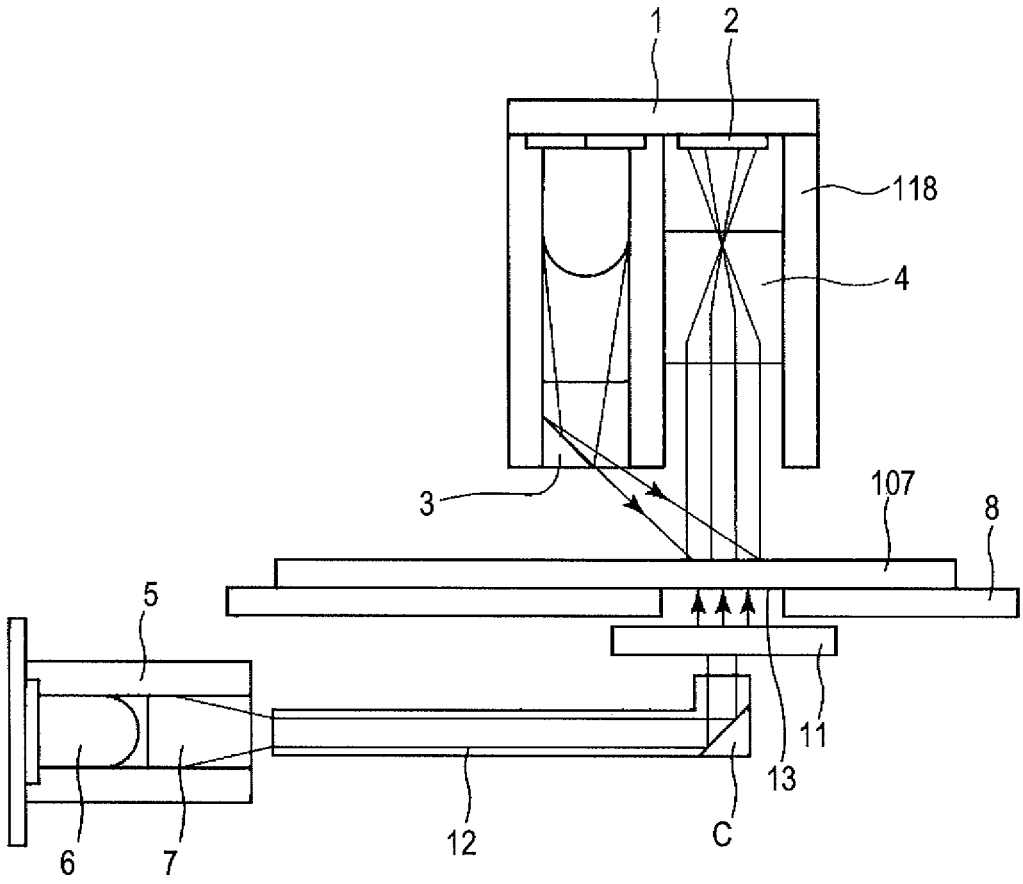
FIG. 5 illustrates a structure of the sensor system according to a third exemplary embodiment of the present invention.

FIG. 5 illustrates the exemplary structure of the sensor system according to the third exemplary embodiment. FIG. 5 shows the recording-medium identification sensor 118, including the LED 1 for reflected light serving as a light-emitting unit, the image pickup element 2 serving as an image reading unit, the condensing lens 3, and the imaging lens 4. The surface of the recording-medium conveying guide 8 or the surface of the recording medium 107 on the recording-medium conveying guide 8 is radiated with light beams emitted from the LED 1 via the condensing lens 3. Light beams reflected from the recording medium 107 are gathered to form an image on the image pickup element 2 via the imaging lens 4. In this third exemplary embodiment, the LED 1 is disposed such that the surface of the recording medium 107 is obliquely radiated with light beams emitted from the LED 1 at a predetermined angle, as shown in FIG. 5.

In FIG. 5, the LED unit 5 is disposed opposite to the recording-medium identification sensor 118 in such a way that the recording medium 107 is disposed between the LED unit 5 and the recording-medium identification sensor 118. The LED 6 for transmitted light illuminates the recording medium 107 from the side adjacent to the back of the recording medium 107. The condensing lens 7 is used for gathering light beams from the LED 6 for transmitted light to emit light to the back of the recording medium 107. The recording-medium conveying guide 8 guides the recording medium 107 and, in the third exemplary embodiment, includes the window to allow the recording medium 107 to be radiated with the light from the side adjacent to the back of the recording medium 107.

In FIG. 5, a light guide 12 is disposed at a position shown in FIG. 5. The light guide 12 functions as a light conducting tube to guide an optical path. The sensor system described above shown in FIG. 5 reads a picture of the surface of the recording medium 107 and the amount of transmitted light that has passed through the recording medium 107 after having been emitted from a side adjacent to the back of the recording medium 107.

The operations according to the third exemplary embodiment are similar to those in the first and second exemplary embodiments, which are described above with reference to FIGS. 2 and 3.

In FIG. 5, it is desirable that the light guide 12 be disposed at a side adjacent to the back of the light diffusing plate 11, which is disposed between the recording medium 107 and the light guide 12. This placement allows light emitted from the LED unit 5 to pass through the light guide 12 and the light diffusing plate 11, and therefore, the recording medium 107 is not directly radiated with the light. In the light guide 12 according to the third exemplary embodiment, regular reflection occurs at a portion C shown in FIG. 5 (plane on a bent part in the light guide 12).

As a result, the image pickup element 2 can detect the difference between the output levels even when the recording medium 107 to be identified is an OHT or a thin sheet.

In addition, due to the light guide 12, the LED unit 5 can be disposed remote from the window used for allowing light to pass through the recording medium 107 in the recording-medium conveying guide 8. Therefore, the LED unit 5 can be disposed at a position suitable for various layouts of components in the color image forming apparatus 100.

Furthermore, light emitted from the LED unit 5 enters the image pickup element 2 serving as the light-receiving element via the light diffusing plate 11, thus preventing the accuracy of detection performed by the recording-medium identification sensor 118 from decreasing and realizing the detection with high accuracy.

Fourth Exemplary Embodiment

The basic structure of the image forming apparatus according to a fourth exemplary embodiment is similar to the structure according to the first exemplary embodiment, which is described with reference to FIG. 6. The image forming apparatus in the fourth exemplary embodiment uses an exemplary sensor system shown in FIG. 12, which is described below, in place of the sensor system shown in FIG. 1 according to the first exemplary embodiment.

Figure 12:
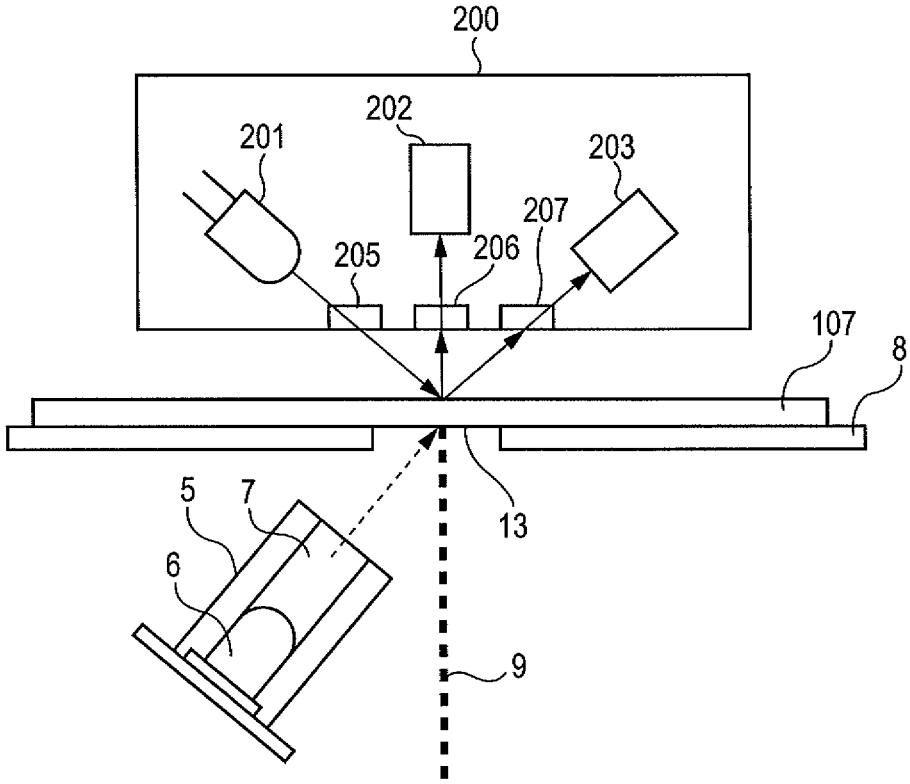
FIG. 12 illustrates a structure of the sensor system according to a fourth exemplary embodiment of the present invention.

FIG. 12 illustrates the structure of the sensor system according to the fourth exemplary embodiment. FIG. 12 shows a recording-medium identification sensor 200, an LED 201 serving as a light-emitting unit, phototransistors 202 and 203 each serving as a light receiving element, slits 205, 206, and 207. The surface of the recording medium 107 on the recording-medium conveying guide 8 is radiated with light beams emitted from the LED 201 via the slit 205. A regular reflection light component within light beams reflected from the recording medium 107 enters the phototransistor 203 via the slit 207. A diffused reflection light component within the light beams enters phototransistor 202 via the slit 206. In the fourth exemplary embodiment, the ratio between the amount of a regular reflection light component and the amount of a diffused reflection light component is calculated, and on the basis of the result of this calculation, the type of the recording medium 107 is determined. The LED 201 is disposed such that the surface of the recording medium 107 is obliquely radiated with light beams emitted from the LED 1 at a predetermined angle, as shown in FIG. 12.

In addition, the LED unit 5 is disposed to determine the basis weight of the recording medium 107. The structure of the LED unit 5 in this fourth exemplary embodiment is similar to that in the first exemplary embodiment. The LED unit 5 includes the LED 6 for transmitted light and the condensing lens 7. The basis weight of the recording medium 107 is determined on the basis of the amount of light that has passed through the window 13 and the recording medium 107 and entered the phototransistor 202 via the slit 206 after having been emitted from the LED 6 for transmitted light.

In this fourth exemplary embodiment, as is the case with the first exemplary embodiment, the LED unit 5 is disposed at a position away from the perpendicular axis 9 of the phototransistor 202 serving as a light-receiving element at a predetermined angle so that diffused transmitted light can enter the light-receiving element. The predetermined angle can be set according to specifications of products. The perpendicular axis 9 corresponds to a perpendicular receiving optical axis of the phototransistor 202 serving as the light-receiving element, as is the case with the first exemplary embodiment.

Although not shown in FIG. 12, the placement of LED unit 5 is the same as that of the arrangement described by the first embodiment (see FIG. 1). That is, L1 denotes an emitting optical axis of light emitted from the LED 6 for transmitted light. $\alpha 1$ is the angle between the L1 and the perpendicular axis 9. L2 denotes an emitting optical axis of light emitted from the LED 201. $\alpha 2$ is the angle between the L1 and the L2. $\beta$ is the angle between the L2 and the perpendicular axis 9. The LED unit 5 is disposed so as to satisfy $\alpha 1<90°$ and where $\alpha 2<\beta$.

As described above, the LED unit 5 for transmitted light is disposed obliquely with respect to the phototransistor (light-receiving element) 202 of the recording-medium identification sensor 200, so that the amount of transmitted light that has passed through the recording medium 107 is detected by using diffused transmitted light. Therefore, the sheet type of the recording medium 107 can be determined more precisely. In addition, the accuracy of detection performed by the recording-medium identification sensor 118 is prevented from decreasing, and the detection with high accuracy is realized.

Other Exemplary Embodiments

The following embodiments listed herein below are also applicable to the present invention.

(1) The color image forming apparatus 100 in the first to third exemplary embodiments may be replaced with a monochrome image forming apparatus. In other words, the monochrome image forming apparatus can use the image sensor system according to the first to third exemplary embodiments.

(2) In the image sensor system according to the first exemplary embodiment, the recording-medium identification sensor (image sensor) 118 for reading an image of the surface is separate from the second light-emitting unit (the LED unit 5) for transmitted light. However, the image sensor unit may include the second light-emitting unit.

(3) The light diffusing plate 11 disposed between the recording medium 107 and the LED unit 5 according to the second exemplary embodiment may be replaced with a light diffusing cap that covers a light emitting port and that is integrally formed with the LED unit 5. Alternatively, the light diffusing plate 11 may be attached to the recording-medium conveying guide 8.

(4) In the image sensor system according to the second exemplary embodiment, the recording-medium identification sensor (image sensor) 118 for reading a surface image is separate from the second light-emitting unit (the LED unit 5 and the light diffusing plate 11) for transmitted light. However, the image sensor unit may include the second light-emitting unit.

(5) In the light guide 12 according to the third exemplary embodiment, regular reflection occurs at the portion C shown in FIG. 5 (plane on a bent part in the light guide 12). However, the surface treatment of the plane of the bent part of the portion C may be made coarse to create a diffusing face. Alternatively, a light diffusing member may be added to the plane on the bent part so that light at the bent part is diffused. This reduces the effects of a picture of light emitted from the LED 6 for transmitted light with respect to light with which the recording medium 107 is radiated.

(6) In the image sensor system according to the third exemplary embodiment, the recording-medium identification sensor (image sensor) 118 for reading a surface image is separate from the second light-emitting unit (the LED unit 5, the light diffusing plate 11, and the light guide 12) for transmitted light. However, the image sensor unit may include the second light-emitting unit.

(7) The color image forming apparatus 100 in the first to third exemplary embodiments uses an electrophotography process. However, the color image forming apparatus 100 is not limited to this. For example, the color image forming apparatus 100 may be replaced with an inkjet image forming apparatus. In other words, the inkjet image forming apparatus can use the image sensor system according to the first to third exemplary embodiments.

(8) The LED for transmitted light according to the first and fourth exemplary embodiments is disposed at a position away from the perpendicular of the light-receiving element. In addition to this, the light diffusing plate, which is described in the second and third exemplary embodiments, may be added so that the output level of the LED for transmitted light can be adjusted. In other words, if the output level is too large even when diffused transmitted light is used, the diffused transmitted light is received via the added light diffusing plate, so that the output level can be adjusted.

(9) The image pickup element as the light-receiving element according to the second and third exemplary embodiments may be replaced with a phototransistor shown in the fourth exemplary embodiment.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

What is claimed is:

1. A sensor comprising:

a first light-emitting unit configured to emit light towards a recording medium;

a second light-emitting unit configured to emit light from a position generally opposite to the first light-emitting unit, the recording medium being disposed between the first light-emitting unit and the second light-emitting unit; and a light receiving unit configured to receive a transmitted light that has passed through the recording medium after having been emitted from the first light-emitting unit, the light receiving unit including an imaging element configured to read the received transmitted light as an image, wherein the first light-emitting unit is arranged on a side where the second light-emitting unit is arranged with the respect to a perpendicular receiving optical axis for the light receiving unit to recieve the transmitted light.

2. The sensor according to claim 1, further comprising, wherein the light receiving unit is configured to receive reflected light that has been reflected from the recording medium after having been emitted from the second light-emitting unit to the recording medium.

3. The sensor according to claim 1, further comprising, the light receiving unit including a first light-receiving sub-unit configured to receive a regular reflection light component within reflection light that has been reflected from the recording medium after having been emitted from the second light-emitting unit to the recording medium and a second light-receiving sub-unit configured to receive a diffused reflection light component within the reflection light.

4. An apparatus for identifying a recording medium, the apparatus comprising:

a sensor configured to detect a characteristic of the recording medium, the sensor including, a first light-emitting unit configured to emit light to the recording medium;

a second light-emitting unit configured to emit light from a position generally opposite to the first light-emitting unit, the recording medium being disposed between the first light-emitting unit and the second light-emitting unit;

a light receiving unit configured to receive a transmitted light that has passed through of the recording medium after having been emitted from the first light-emitting unit, the light receiving unit including an imaging element configured to read the received transmitted light as an image, wherein the first light-emitting unit is arranged on a side where the second light-emitting unit is arranged with respect to a perpendicular receiving optical axis for the light receiving unit to receive the transmitted light; and a control unit configured to identify the recording medium on the basis of an output from the light receiving unit.

5. The apparatus according to claim 4, wherein the light receiving unit is configured to receive a reflected light that has been reflected from the recording medium after having been emitted from the second light-emitting unit to the recording medium, and wherein the control unit is configured to identify the recording medium on the basis of a first output from the light receiving unit when the first light-emitting unit emits the light and a second output from the light receiving unit when the second light-emitting unit emits the light.

6. The apparatus according to claim 4, wherein the light receiving unit includes a first light-receiving sub-unit configured to receive a regular reflection light component within reflection light that has been reflected from the recording medium after having been emitted from the second light-emitting unit to the recording medium, and a second light-receiving sub-unit configured to receive a diffused reflection light component within the reflection light, and wherein the control unit is configured to identify the recording medium on the basis of a first output from the first light-receiving sub-unit and a second output from the second light-receiving sub-unit.

7. The apparatus according to claim 4, wherein the first light-emitting unit and the second light-emitting unit are arranged in such a way that an angle between an optical axis of the light emitted from the first light-emitting unit toward the recording medium and an optical axis of the light emitted from the second light-emitting unit toward the recording medium is smaller than an angle between the optical axis of the light emitted from the second light-emitting unit and the perpendicular optical axis of the light receiving unit.

8. An image forming apparatus comprising:

an image forming unit configured to form an image on a recording medium;

a sensor configured to detect a characteristic of the recording medium, the sensor including a light-emitting unit configured to emit light towards the recording medium;

a second light-emitting unit configured to emit light from a position generally opposite to the first light-emitting unit, the recording medium being disposed between the first light-emitting unit and the second light-emitting unit;

a light receiving unit configured to receive a transmitted light that has passed through the recording medium after having been emitted from the first light-emitting unit; and a controller configured to control an image forming condition of the image forming unit, wherein the first light-emitting unit is arranged on a side where the second light-emitting unit is arranged with respect to a perpendicular receiving optical axis for the light receiving unit to receive the transmitted light, and wherein the first light-emitting unit and the second light-emitting unit are arranged in such a way that an angle between an optical axis of the light emitted from the first light-emitting unit toward the recording medium and an optical axis of the light emitted from the second light-emitting unit toward the recording medium is smaller than an angle between the optical axis of the light emitted from the second light-emitting unit and the perpendicular optical axis of the light-receiving unit.

9. The image forming apparatus according to claim 8, wherein the light receiving unit is configured to receive reflected light that has been reflected from the recording medium after having been emitted from the second light-emitting unit to the recording medium, wherein an angle between the first emitting optical axis line of the first light- emitting unit and a second emitting optical axis line of the second light-emitting unit is smaller than an angle between the second emitting optical axis line of the second light- emitting unit and the straight line.

10. A sensor comprising:

a first light-emitting unit configured to emit light toward a recording medium;

a second light-emitting unit configured to be arranged opposite to the first light-emitting unit with the recording medium therebetween and configured to emit light toward the recording medium; and a light receiving unit configured to receive a light that has been emitted from the first light-emitting unit or the second light-emitting unit toward the recording medium and passed through the recording medium, the light receiving unit including an imaging element configured to read the received transmitted light as an image, wherein the second light-emitting unit and the light-receiving unit are arranged side by side in a direction parallel with a conveyance direction of the recording medium, and wherein the first light-emitting unit is arranged in such a way that a distance between the first light-emitting unit and the second light-emitting unit is shorter than a distance between the first light-emitting unit and the light receiving unit.

11. The sensor according to claim 10, wherein the light receiving unit receives a diffused light that has passed through the recording medium after having been emitted from the first light-emitting unit and a diffused reflection light that has been reflected from the recording medium after having been emitted from the second light-emitting unit.

12. An apparatus for identifying a recording medium, the apparatus comprising:

a first light-emitting unit configured to emit light toward a recording medium;

a second light-emitting unit configured to be arranged opposite to the first light-emitting unit with the recording medium therebetween and configured to emit light toward the recording medium;

a light receiving unit configured to receive a light that has been emitted from the first light-emitting unit or the second light-emitting unit toward the recording medium and passed through the recording medium, the light receiving unit including an imaging element configured to read the received transmitted light as an image; and a determination unit configured to determine a type of a recording medium based on an output from the light receiving unit, wherein the second light-emitting unit and the light-receiving unit are arranged side by side in a direction parallel with a conveyance direction of the recording medium, and wherein the first light-emitting unit is arranged in such a way that a distance between the first light-emitting unit and the second light-emitting unit is shorter than a distance between the first light-emitting unit and the light receiving unit.

13. The sensor according to claim 12, wherein the light receiving unit receives a diffused light that has passed through the recording medium after having been emitted from the first light-emitting unit and a diffused reflection light that has been reflected from the recording medium after having been emitted from the second light-emitting unit.

14. An image forming apparatus comprising:

an image forming unit configured to form an image on a recording medium;

a first light-emitting unit configured to emit light toward a recording medium;

a second light-emitting unit configured to arranged opposite to the first light-emitting unit with the recording medium therebetween and configured to emit light toward the recording medium;

a light receiving unit configured to receive a light that has been emitted from the first light-emitting unit or the second light-emitting unit toward the recording medium and passed through the recording medium, the light receiving unit including an imaging element configured to read the received transmitted light as an image; and a controller configured to control an image forming condition of the image forming unit based on a output from the light receiving unit, wherein the second light-emitting unit and the light-receiving unit are arranged side by side in a direction parallel with a conveyance direction of the recording medium, and wherein the first light-emitting unit is arranged in such a way that a distance between the first light-emitting unit and the second light-emitting unit is shorter than a distance between the first light-emitting unit and the light receiving unit.

15. The sensor according to claim 14, wherein the light receiving unit receives a diffused light that has passed through the recording medium after having been emitted from the first light-emitting unit and a diffused reflection light that has been reflected from the recording medium after having been emitted from the second light-emitting unit.

* * * * *